United States Patent [19]

Pawlik et al.

[11] 4,233,494

[45] Nov. 11, 1980

[54] THROUGHFLOW ELECTRIC HEATER FOR FLUIDS SUCH AS AIR

[75] Inventors: Rudolf Pawlik, Wofratshausen; Walter Fierlbeck, Munich, both of Fed. Rep. of Germany

[73] Assignee: Linde Aktiengesellschaft, Wiesbaden, Fed. Rep. of Germany

[21] Appl. No.: 923,672

[22] Filed: Jul. 11, 1978

[30] Foreign Application Priority Data

Jul. 15, 1977 [DE] Fed. Rep. of Germany ..... 2732133

[51] Int. Cl.[3] ..... H05B 3/02; F24H 3/04

[52] U.S. Cl. ..... 219/382; 219/298; 219/300; 219/307; 219/319; 219/367; 219/374; 219/536; 219/537; 219/539; 338/55; 422/174; 422/199

[58] Field of Search ..... 219/300, 298, 306, 307, 219/316, 319, 320, 321, 335, 336, 338, 367, 374–376, 379–382, 373, 536, 537, 539; 422/198, 199, 173, 174; 338/55, 56, 57

[56] References Cited

U.S. PATENT DOCUMENTS

| | | | |
|---|---|---|---|
| 912,985 | 2/1909 | Aalborg | 219/300 X |
| 1,712,372 | 5/1929 | Winship | 219/319 |
| 1,727,585 | 9/1929 | Carleton | 219/307 X |
| 2,619,579 | 11/1952 | Cartinhour | 219/374 X |
| 2,790,889 | 4/1957 | Hynes | 219/539 |
| 2,797,297 | 6/1957 | Nihlen | 219/381 X |
| 2,868,944 | 1/1959 | Koch et al. | 219/307 X |
| 3,270,182 | 8/1966 | Hynes | 219/307 X |
| 3,541,304 | 11/1970 | Cohn | 219/307 X |

FOREIGN PATENT DOCUMENTS

| | | | |
|---|---|---|---|
| 1954157 | 10/1966 | Fed. Rep. of Germany | 219/307 |
| 1615278 | 7/1970 | Fed. Rep. of Germany | 219/374 |
| 1293413 | 4/1962 | France | 219/319 |
| 985091 | 3/1965 | United Kingdom | 219/374 |

*Primary Examiner*—A. Bartis
*Attorney, Agent, or Firm*—Karl F. Ross

[57] ABSTRACT

Air is pumped from an upper chamber in a cylindrical housing through parallel groups of Ni-Cr steel heating tubes to a lower chamber communicating with a carbon-dioxide adsorber in an air-rectification system. The tube groups are suspended at their upper ends from respective $Al_2O_3$-ceramic holder plates seated on flanges projecting into respective openings of a carrier plate in turn removably fastened to the inside of the housing. The tubes in each group are connected in series with one another to a voltage source, the lower ends of the tubes in a group being gripped by a form-fitted ceramic spacer slidably inserted into a pipe section aligned in a support plate with an associated opening in the upper carrier plate, thereby ensuring the electrical insulation of the tubes. The holder plates and the openings are shaped as circles or as circular sections.

2 Claims, 4 Drawing Figures

THROUGHFLOW ELECTRIC HEATER FOR FLUIDS SUCH AS AIR

FIELD OF THE INVENTION

Our present invention relates to a throughflow heater for fluids and, in particular, to an air heater for use in regenerating a carbon-dioxide adsorber in an air-rectification system.

BACKGROUND OF THE INVENTION

In the present state of the air-rectification art, hot air for regenerating carbon-dioxide adsorbers is passed through a bundle of parallel tubes mounted in a housing and in which are inserted heating coils each separately connected to a voltage source. In the event of a break in one of the coils, the entire bundle of tubes must be removed from the housing, thereby completely interrupting operations until the defect has been repaired. A further disadvantage is that the heating coils exert a large drag force on the moving fluid, greatly increasing the pressure gradient along the length of the tubes.

Reference may be had to German printed application (Auslegeschrift) DT-AS No. 16 15 278 and the references therein cited (U.S. Pat. No. 3,270,182 and German utility model—Gebrauchsmuster-DT GM No. 19 54 157) which discloses an electric furnace or gas heater consisting of a bundle of mutually contacting tubes, preferably disclosed in a hexagonal array (hexagonal-close-packed relation) and provided internally with the heating coils.

Such tube bundles can be disposed between the inlet and outlet ends of a housing surrounding the tube bundle and confining the gas to flow through the interiors of the tubes.

Among the disadvantages of such systems are the difficulties in replacing a coil which fails, the need to disassemble the tube bundle in a complicated way and with long downtime of the apparatus for replacement of the tube bundle or one or more tubes or coils thereof, and the considerable resistance to flow of the fluid through the tubes in which the coils function as turbulence-inducing members. The pressure drop between the inlet and outlet sides of the tube bundle is thus high.

OBJECTS OF THE INVENTION

The primary object of the present invention is to provide an improved heater for fluid in which the aforedescribed disadvantages are avoided and wherein a gaseous medium can be heated efficiently and with a small pressure drop.

Another object of the invention is to provide a gas heating device, especially an air heater, which can sustain high throughputs at low pressure drops, is inexpensive to fabricate and maintain, and which can be economically operated for long periods of time.

Still another object of the invention is to provide a readily repairable and maintainable air heater which has a minimum pressure drop between its inlet and outlet sides and is capable of rapidly raising the temperature of a large volume of gas fed therethrough.

An important object is also to obviate the disadvantages of the earlier system described above.

An object of our present invention is also to provide in an air-rectification system an air heater which has a long life expectancy and whose operating and repair costs are minimal.

SUMMARY OF THE INVENTION

These objects and others which will become apparent hereinafter are attained, in accordance with the present invention which comprises a fluid throughflow heater formed with a multiplicity of tubes each of which constitutes a resistance heater and is traversed by an electric current to develop ohmic heat which is transferred to the gas or to the fluid traversing these tubes from an inlet side to an outlet side thereof. The interiors of the tubes are completely cylindrical and clear, being free from all formations which might tend to impede fluid flow therethrough.

According to the invention, therefore, the resistance-heating coils are completely eliminated and the resistance-heating elements become the tubes themselves and thus the tubes are directly heated by ohmic heat generation.

According to an essential feature of the invention, the corresponding ends of a plurality of such tubes, say the inlet ends thereof, are secured in electrically nonconductive heat resistant and refractory holder plates with a plurality of such holder plates and the corresponding groups of tubes being mounted, in turn, in corresponding openings of a common carrier plate. The latter may, in turn be affixed upon a support ring or mounting ring in the housing of the heater.

The use of resistance-heated tubes of electrically conductive material but of sufficient resistance such that the $I^2R$-generated heat from the current I traversing the tubes of resistance R in an amount to raise the temperature of the gas to the desired degree has a distinct advantage over the use of heating coils in the tubes in that the flow resistance is significantly reduced.

In addition, the electrical capacity of the system can be increased because the current-flow cross section of the tubes is a function of their diameter and the wall thickness and is not limited by the requirement for heating coils or wires. In addition, the system has high mechanical stability and thus increased useful life because the heating elements, namely, the tubes themselves are not mechanically sensitive which is the case with coils. Coils, for example, are subjected to vibration as the tubes containing the same are traversed by the gas which evidently gives rise, in conjunction with the high temperature of the coils, to metal fatigue.

According to the invention, the carrier plate lies horizontally and the groups of tubes anchored in the refractory nonconductive holder plates are suspended vertically or hung from the carrier plate. As a consequence, if it is necessary to remove one tube or a group of tubes, there is little danger of mechanically disturbing the other tubes of the system and the removed tube or set of tubes can be replaced with a minimum delay in the operation of the electrical heater. At the locations of the holder plates, i.e. in the respective openings, it is also possible to temporarily insert a closure plate, thereby only minimally reducing the flow cross section of the heater during repair of a tube or set of tubes. Furthermore, because a tube or group of tubes may be readily replaced, removed and substituted for by a closure plate, it is possible to adjust the total cross section of the heater to the throughputs of the fluid.

A air heater according to our present invention can comprise a housing and an exit chamber, the exit chamber being provided with a fluid outlet. A plurality of heat-resistant, electrically non-conductive holder plates are mounted in respective openings in a carrier plate attached to the housing. A plurality of electrically conductive tubes are gripped by the holder plates and extend from the antechamber to the exit chamber, an electric-current source being connected across the tubes. A pressurized-air source or compressor communicates with the antechamber for introducing thereinto a stream of air to be heated by the tubes upon passing therethrough to the exit chamber.

According to a feature of our invention, the housing is substantially vertically oriented, the antechamber and second exit chamber constituting upper and lower chambers, respectively. The carrier plate is oriented horizontally and provided with flanges projecting into the openings, the holder plates being seated within said openings on said flanges. The heating tubes are suspended at their upper ends from the carrier plate by means of the holder plates.

According to another feature of our invention, the upper chamber can be provided with a removable cover member aligned with the openings in the carrier plate, this plate in turn being removably fastened to a shelf rigid with an inside surface of the housing. Thus, in an air heater according to our invention, the heating elements may be extracted by simply uncovering the upper chamber and lifting the tubes with their associated holder plates out of the housing. All the tubes may be removed by detaching the carrier plate and lifting it out with a crane.

According to our invention, each holder plate grips a plurality of tubes which are connected in series with one another to the voltage source, thereby decreasing the number of connecting leads needed. Spacer members are attached to the tubes for ensuring the electrical insulation thereof.

According to yet another feature of our invention, the openings in the carrier plate are shaped as symmetrically arranged sections or wedges.

In comparison to inlaid heating coils, solid conducting tubes have the advantages of a smaller resistance to fluid flow, a higher electrical-load capacity, greater mechanical stability and a longer life expectancy.

The electrical hookup of the tubes can be effected in different ways as may be desired for the associated advantages.

For instance, the simplest wiring of the system to the current supply network provides for parallel connection of all groups of tubes with one another and all of the tubes within each group with one another, to the supply terminals of the current source. However, in many cases it is desirable to increase the resistance across these terminals and in this case the most advantageous connection scheme is one in which all groups of tubes are connected in parallel with one another across the terminals of the current supply source but, within each group, the tubes are connected electrically in series. Naturally, it is also possible to connect the tubes of each group in parallel with one another but to electrically connect the groups of tubes in series across the current supply source.

A particularly effective connecting mode is attached and corresponds to the best mode currently known to us for carrying out the invention in practice, when the current supply source is a three-phase network. In this case, the groups of tubes associated with each phase are connected electrically in series and, with Y interconnection and uniform impedances in all their phases, the neutral conductor can be eliminated without detrimentally affecting the current supply.

In the vertically oriented air heater of the present invention, the tubes of each group are secured together by respective holder plates or spacers at opposite ends of the tube groups, the holder plates resting upon the carrier plate provided with the openings as previously described. This constitutes a releasable connection to the inner wall of the housing. The plate spacers, in turn, may pass with clearance through tube members defining openings in a support plate in the bottom part the group of tubes to be removed in a simple manner. The particular construction which is used in accordance with the present invention allows the carrier plate to be lifted from the housing, e.g. by the aforementioned crane, to facilitate cleaning of the inner walls of the housing. Thus the invention provides the possibility of removing groups of tubes or the entire tube assembly from the housing as required. Naturally, when the heater is of the upright type, the support plate can be eliminated entirely and the tubes simply suspended frm their upper ends.

BRIEF DESCRIPTION OF THE DRAWING

These and other features of our present invention will now be described in detail, reference being made to the accompanying drawing in which.

SPECIFIC DESCRIPTION

Figure 1:
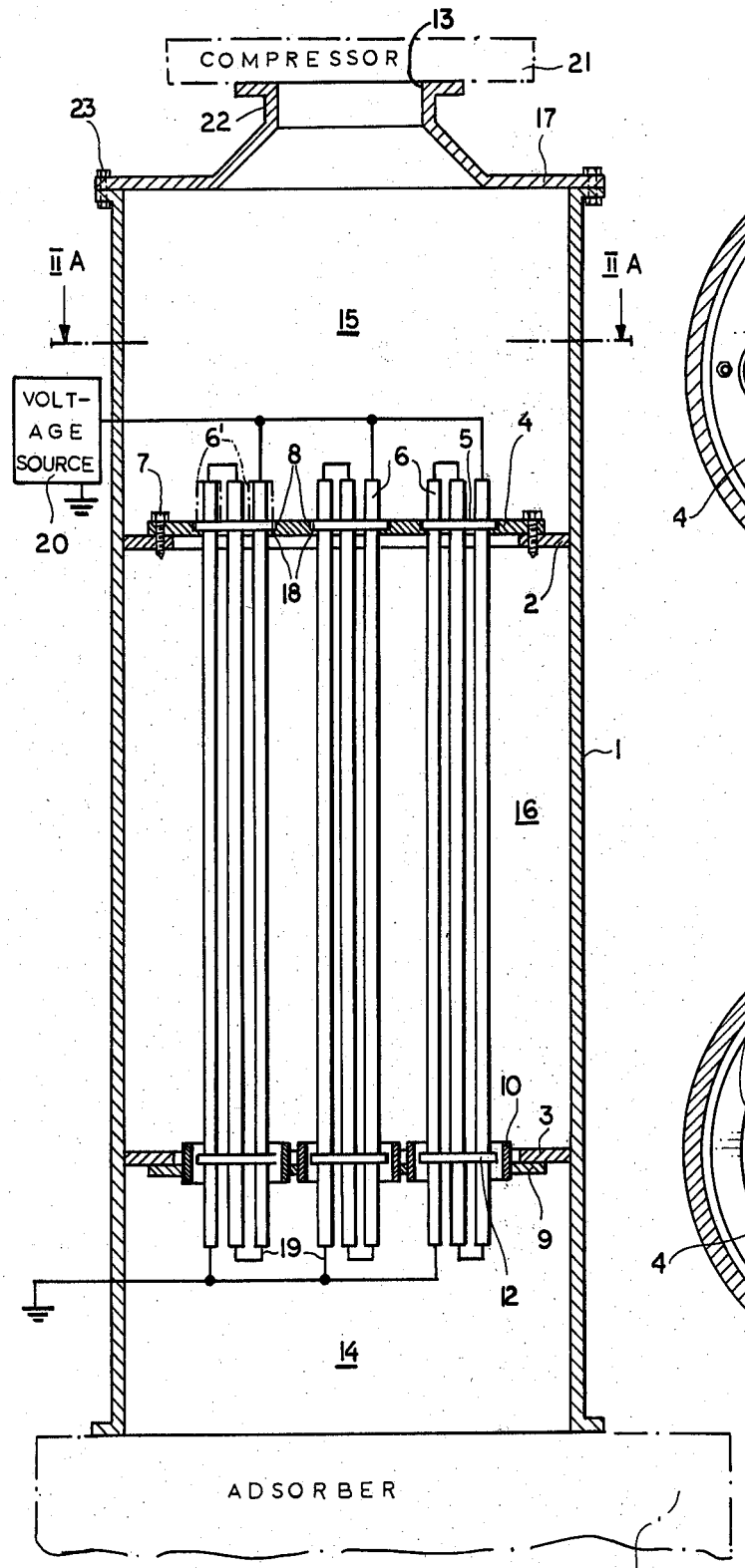
FIG. 1 is a longitudinal cross-sectional view, partly diagrammatic, of an air heater according to our invention.
Figure 2A:
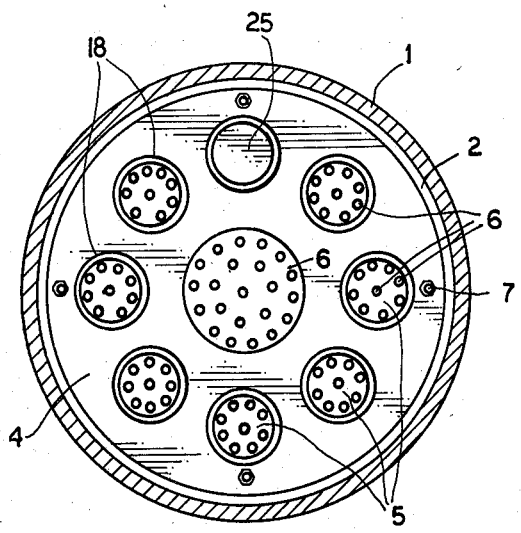
FIG. 2*a* is a cross-sectional view taken along line II—IIA in FIG. 1.

As we have shown in FIGS. 1 and 2*a*, an air heater according to our present invention comprises an upright cylindrical housing 1 fabricated preferably from carbon steel and formed on an inner surface with a pair of annular shelves 2, 3, a carrier plate 4 provided with a plurality of circular openings 8 being fastened by screws 7 to upper shelf 2.

Into each opening 8 projects an annular lip or flanges 18 which forms a seat for a respective circular holder plate 5, these holder plates being made from a heat-resistant, electrically non-conductive material such as sintered aluminum oxide ($Al_2O_3$).

Each holder plate 5 embraces a group of electrically conductive elongated open-ended tubes 6 connected to one another in a series circuit 19 across an external voltage source 20.

The tubes are preferably made of nickel-chromium steel and are press-fitted into bores of their respective holder plates. Alternatively, tubes 6 may be provided with enlarged top portions 6' whose bottom rims thrustingly engage upper surfaces of holder plates 5, or tubes 6 may include threaded upper portions interfitting with nuts (not illustrated). The tubes 6 can also be expanded to a press fit into the holder plates.

In addition to being mounted in holder plates 5, tubes 6 are engaged at their lower ends by spacers 12 for ensuring against possible shorting out of circuits 19. Spacers 12 are ceramic plates form-fitted around tubes 6 and slidably inserted into tube members 10 rigid with a support plate 9 attached to lower shelf 3. Thus, spacers 12 serve to electrically insulate the tubes of a group from one another, while tube sections 10 coact with the spacers 12 to inhibit lateral swinging of the various tube groups.

As illustrated in FIG. 1, a cover member 17 with a collar projection 22 forming an a fluid inlet 13 is removably attached to housing 1 by means of bolts 23. Cover 17, housing 1 and carrier plate 4 together define an antechamber 15 communicating on one side with a compressor 21 via a fluid inlet 13 and on an opposite side with an exit chamber 14 via tubes 6. At the exit chamber 14, the heater housing 1 is connected, for example, to a carbon-dioxide adsorber 24 in an air-rectification system of the Linda-Fräankl type.

During the operation of an air heater according to our present invention, air is pumped by compressor 21 into antechamber 15, through heating tubes 6 and into exit chamber 14, from whence hot air flows into adsorber 24 for regenerating the same.

A buffer chamber 16 (FIG. 1) gradually fills with air leaking from chambers 14 and 15 during the operation of the air heater, this air serving to insulate tubes 6 and generally not taking part in the fluid flow from the compressor 21 to the adsorber 24. It is to be noted that pressure drops along the length of the air heater are minimized by the omission of heating coils inside tubes 6 and that the life expectancy of these tubes is substantially longer than that of heating coils. Thus, operating costs of an air heater according to our invention are reduced for at least these two reasons. In addition, initial costs are reduced by having the tubes 6 in a group connected in series to source 20, the number of connecting leads being decreased.

Figure 2B:
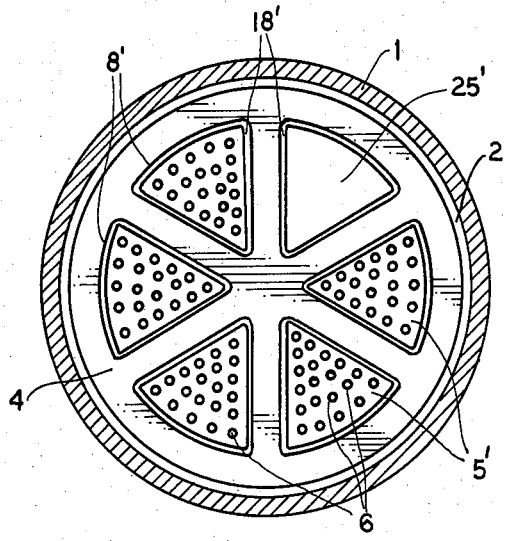
FIG. 2*b* is a cross-sectional view similar to that shown in FIG. 2*a*, but showing a modification thereof.

The shapes and configuration of the openings in the carrier plate 4 and of the associated holder plates may vary in accordance with operating conditions. As we have shown in FIG. 2*b*, alternative openings 8' and holer plates 5' are formed as circular segments, that is, substantially as wedge or pie-slice shapes, while lips or flanges 18' are generally triangular in outline.

An advantage of an air heater according to our invention is that, upon malfunction of a tube 6, the tube and its holder 5 (or 5') may be extracted from the housing 1 to be temporarily replaced in the associated opening 8 (or 8') by a closure plate 25 (or 25', see FIGS. 2*a* and 2*b*) blocking the flow of air from antechamber 15 to buffer chamber 16. Thus, the operation of the air heater continues with only a very minor delay necessary for the removal of the disabled tube and the seating of closure plate 25 (or 25') upon flange 18 (or 18'). Another advantage is that the flow rate of air through the heater may be decremented stepwise, in accordance with load conditions, by replacing a successively increasing number of holders 5 (or 5') and suspended tubes 6 by closure plates 25 (or 25'). Furthermore, cleaning of the housing is facilitated by simply extracting screws 7 and then lifting carrier plate 4, together with all the holder plates 5 and tubes 6, by means of a crane (not shown).

Figure 3:
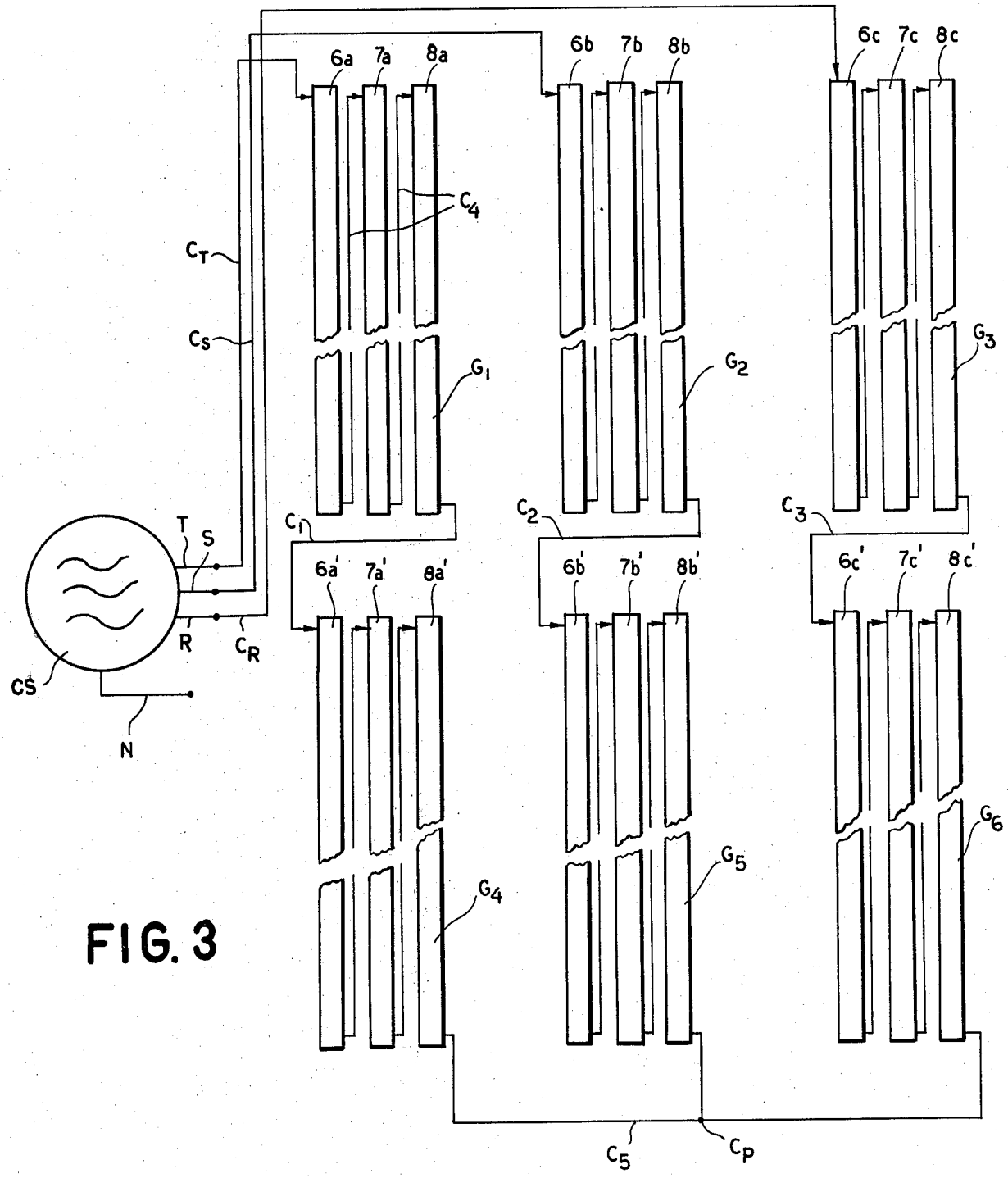
FIG. 3 is a diagram of the electrical hooking of tubes according to the invention.

In FIG. 3 we have shown a system according to the invention in which the number (six) of groups of tubes has 3 as a factor and can be energized by an alternating current three-phase supply without utilizing the neutral terminal.

The three-phase supply is represented at CS in FIG. 3 and has power terminals R, S and T as well as the neutral terminal N as is common with a Y-connected system.

In this case, the six groups of pipes are represented at $G_1$, $G_2$, $G_3$, $G_4$, $G_5$ and $G_6$, respectively, each having a holder plate common to the tubes thereof and mounted in the circuit carrier plate 4 as previously described. In this embodiment, however, two groups $G_1$ and $G_4$, $G_2$ and $G_5$, and $G_3$ and $G_6$ of tubes are electrically connected in series by conductors $C_1$, $C_2$ and $C_3$ respectively.

Each of the terminals R, S and T is connected by a respective conductor $C_R$, $C_S$ and $C_T$ to the first tube 6*a*, 6*b* or 6*c* of the series connected tubes of the groups.

Within each group, the tubes 6*a*, 7*a*, 8*a* or 6*a'*, 7*a'*, 8*a'* or 6*b*, 7*b*, 8*b* or 6*b'*, 7*b'*, 8*b'*, or 6*c*, 7*c*, 8*c* or 6*c'*, 8*c'* are electrically connected in series by further conductors to show which have been shown at $C_4$.

At the opposite (electrical) ends of each series connected set of tubes, conducters $C_5$ tie them together to a common point $C_p$. This point need not be connected to the neutral terminal N.

Thus, in the three-phase system of FIG. 3, the tubes of each group G1–G6 are electrically connected in series, the current supply is via the three-phase alternating current network and the two groups of each phase are electrically connected in series.

We claim:

1. An electrical fluid heater comprising:

a cylindrical housing;

a plurality of mutually parallel, open-ended, electrically conductive resistive-heating tubes within said housing;

a removable cover member provided with a fluid inlet, the cover member forming one end of said housing, and a fluid outlet at the other end of said housing;

a carrier plate within said housing, being provided with a plurality of openings, the carrier plate extending approximately over the entire cross section and being removably and in an essentially fluid-tight way mounted to the inner wall of the housing, thereby defining a first or antechamber with said cover member and the inner wall of said housing at said one end;

a plurality of holder plates equal in number with said openings in said carrier plate, each opening receiving in an easily removable and nearly fluid-tight manner one holder plate, each holder plate being formed from an electrically nonconductive refractory material and provided with a number of bores each receiving in a tight-fitting manner one of said tubes, the tubes received by the bores of one holder plate forming a group, the totality of groups constituting said plurality of tubes;

a support plate within said housing provided with openings equal in number with the openings in said carrier plate, the support plate being mounted in a nearly fluid-tight manner to the inner wall of said housing, thereby defining a second or buffer chamber with the carrier plate and the inner wall of the intermediate portion of said housing and a third or exit chamber with the inner wall of said other end of said housing, each opening of the support plate receiving one of said groups of tubes, each group being engaged in an electrically insulating heat-resistant spacer arranged within the respective opening of the support plate;

a flow path for the fluid to be heated defined by said fluid inlet, said antechamber, said tubes, said exit chamber and said fluid outlet, the tubes extending from the antechamber through said holder plates, said buffer chamber and the openings in said support plate to the exit chamber;

a voltage source connected across the tubes; and a fluid source communicating with said fluid inlet for introducing thereinto a stream of fluid to be heated by said tubes upon passing therethrough to said fluid outlet.

2. A heater as defined in claim 1 wherein said housing is substantially vertically oriented, said first, second and third chambers constituting an upper, an intermediate and a lower chamber, respectively, the inner wall of said housing being provided with a ring-shaped shelf oriented essentially horizontally, said carrier plate being removably attached to or deposited on said shelf and being provided with flanges projecting into its said openings, said holder plates being deposited substantially within said openings on said flanges, said tubes being suspended at their respective upper ends from said carrier plate by means of said holder plates.

* * * * *